United States Patent [19]

Hatzenbichler et al.

[11] 4,035,142

[45] July 12, 1977

[54] CONTINUOUS HEATING FURNACE FOR ELONGATED METAL INGOTS

[75] Inventors: Ernst Hatzenbichler, Dusseldorf; Eckard Bunzel, Kaarst, both of Germany

[73] Assignee: "OFU" Ofenbau-Union GmbH, Dusseldorf, Germany

[21] Appl. No.: 641,017

[22] Filed: Dec. 15, 1975

[30] Foreign Application Priority Data

Dec. 17, 1974 Germany ..... 2459511

[51] Int. Cl.[2] ..... F27D 23/00

[52] U.S. Cl. ..... 432/249; 432/245

[58] Field of Search ..... 432/121, 123, 126, 127, 432/146, 10, 12, 249, 233–235, 253, 5, 8, 245, 226, 194, 42, 59; 266/261, 103, 105; 219/411

[56] References Cited

U.S. PATENT DOCUMENTS

| | | | |
|---|---|---|---|
| 1,329,745 | 2/1920 | Benjamin | 432/121 |
| 1,333,767 | 3/1920 | Napier | 266/105 |
| 1,910,549 | 5/1933 | Junker | 432/8 |
| 2,199,138 | 4/1940 | Moore | 432/10 |
| 2,664,282 | 12/1953 | Mann | 432/8 |
| 2,673,080 | 3/1954 | Hepburn et al. | 432/8 |
| 3,616,533 | 11/1971 | Heap et al. | 432/245 |
| 3,637,198 | 1/1972 | Knaak | 432/234 |
| 3,733,709 | 5/1973 | Bassemir et al. | 34/4 |
| 3,879,164 | 4/1975 | Haldopoulous et al. | 432/10 |

FOREIGN PATENT DOCUMENTS

| | | | |
|---|---|---|---|
| 4,654 | 3/1884 | United Kingdom | 432/5 |

*Primary Examiner*—John J. Camby
*Assistant Examiner*—Henry C. Yuen

[57] ABSTRACT

A continuous heating furnace having a heating chamber for the passage therethrough of a metal ingot heated predominantly by radiant heat from the walls of the furnace and comprising a plurality of screening shield arranged adjacent the conveying path of the ingots at the ends thereof for forming niches to reduce the size of the heating chamber in the region of the ends of the ingots. The screening shields are mounted in the furnace in front of the furnace walls by mechanisms for adjusting the position of the shields to adjust the spacing with the ingot.

6 Claims, 3 Drawing Figures

CONTINUOUS HEATING FURNACE FOR ELONGATED METAL INGOTS

FIELD OF THE INVENTION

The invention relates to a continuous heating furnace for elongated metal ingots, such as slab ingots which are transported transversely through the furnace, in one or several rows, and are heated predominantly by radiant heat from the furnace walls.

BACKGROUND

Rolled strips produced from metal ingots heated in such a furnace are of different quality at their beginning and their end, as compared with the rest of the strip. Such differences in quality are unwanted especially with transformer laminations. Investigations have shown that peak temperatures in the area of the ends of the ingots are responsible for these differences quality. The peak temperatures at the ends of the ingots can be 20° to 30°C. higher, than the temperature of the remaining part of the ingot. This variation in heating is a consequence of the ingot being heated from five sides in the area of the ends, whereas in the middle part it is heated from four sides, only. With continuous heating furnaces operated at temperatures exceeding 800° C., heating is effected approximately 80% by radiant heat.

SUMMARY OF THE INVENTION

The invention seeks to solve the problem of producing a continuous heating furnace for elongated metal ingots which is capable of heating the ingots uniformly, over their entire length, whereby no peak temperatures occur at the ends and, thus, a uniform temperature is achieved for the whole ingot.

According to the invention, the problem is solved in that screening shields are provided along the conveying paths of the ingot ends which shield the ingot ends from the radiant heat of the furnace walls. By means of these screening shields, the surface of the furnace walls emitting the radiant heat which acts on the ingot ends is reduced in size. The reduced intensity of the radiant heat, thus involved, slows that due to the heating surface of each ingot end showing five free sides, no peak temperatures occur at the ingot ends. The distance between the screening shields and the ingot surface (top) is approximately 300 mm.

Preferably, the screening shields are designed to form niches which narrow the open space in the furnace chamber within the range of the ingot ends. The screening shields can extend nearly along the entire furnace length. In such case, cooling of the screening shields is not necessary. For this reason, the operation of such a furnace is especially economical.

However, the screening shields can also be equipped with cooling devices. For reasons of expedience, these are then arranged at the discharge end of the furnace, only. When installing cooled screening shields, it is not necessary for them to be extended across the total furnace length, as cooling devices for the screening shields are not of advantage in regard to economy.

The sides and height of the screening shields can, if necessary, be adjusted in order to adapt the screening shields to different cross sections and lengths of the ingot.

The principle of the invention, accordingly, is based on the realization that part of the radiant heat transmission contributing 80% to the heating process has to be screened off within the range of the ingot ends by reducing the free furnace cross section in order to obtain ingots that are uniformly heated over their entire length.

Certainly, it has been known so far that with continuous heating furnaces wherein the ingots are heated mainly be means of convection of the furnace atmosphere, peak temperatures at the ingot ends, requiring an intense flow of flue gases, can be reduced by arranging the ingots in a second chamber within the furnace chamber proper which is designed so that there is substantially no flow of hot gases. However, if such a furnace were operated at higher temperatures wherein the ingots are heated predominantly by means of radiant heat, peak temperatures would occur at the ingot ends in spite of the cut off flow of flue gases, since the walls of the second furnace chamber also emit radiant heat to the ingot ends (DT-OS No. 1,483,035).

BRIEF DESCRIPTION OF THE DRAWINGS

The invention is, hereafter, explained in greater detail with reference to the attached drawing showing various embodiments.

DETAILED DESCRIPTION

Figure 1:
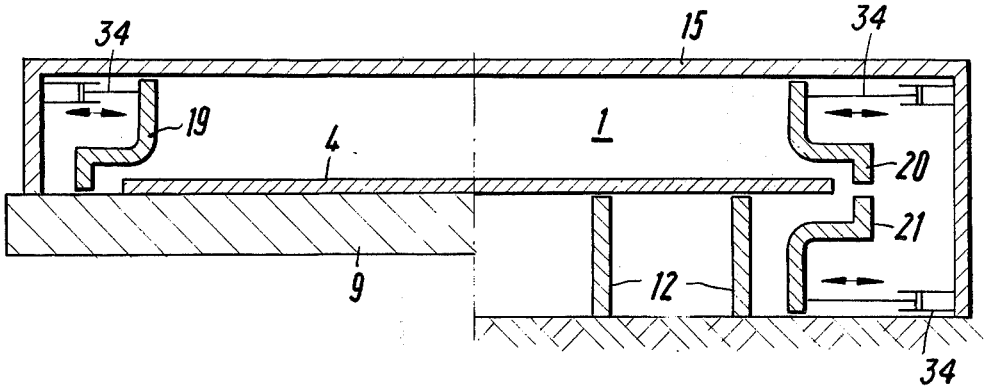
FIG. 1 shows a pusher-type furnace in which on the left-hand side a stationary hearth or bottom is shown, and on the right-hand a skid rail hearth or beam furnace is shown, for ingots which extend across almost the entire furnace width, and are transported transversely.
Figure 2:
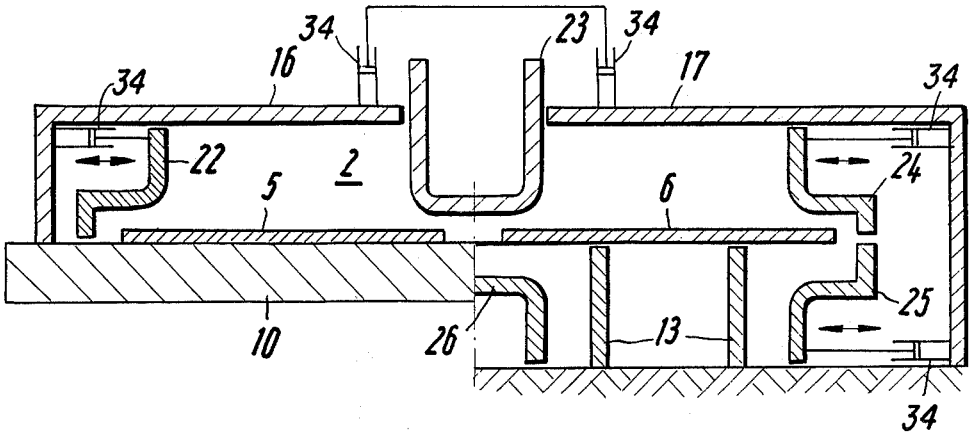
FIG. 2 is a cross section of a pusher-type furnace for transverse transport of ingots in two rows arranged in parallel, i.e. on the left-hand side a stationary hearth, and on the right-hand side a skid rail hearth.
Figure 3:
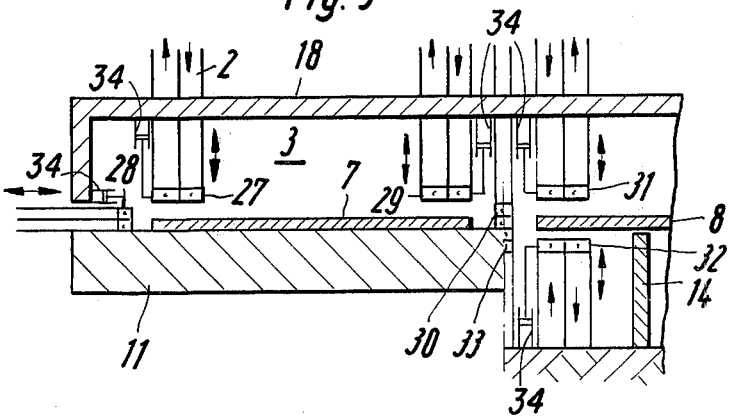
FIG. 3 shows a portion of the pusher-type furnace corresponding to FIG. 2, however, with different screening shields.

The continuous heating furnaces show the drawing in cross section can be designed as stationary hearth furnaces, skid rail hearth furnaces or walking beam hearth furnaces, comprise a furnace chamber 1, 2, 3 through which the ingots 4, 5, 6, 7, 8 can be transported tranversely in single-row arrangement (FIG. 1) or in several rows (FIGS. 2 and 3). The ingots rest either on the furnace floor 9, 10, 11, or on skid rails or beams 12, 13, 14.

In order to protect the ingot ends against radiant heat from the surface of the furnace 15, 16, 17, 18 included on the furnace roof, the side walls, and possibly the furnace floor, screening shields 19–33 are provided within the region of the ingot ends. As far as the ingots 4, 5, 7 are transported on the furnace floor 9, 10, 11 it is sufficient if the free furnace chamber space is narrowed by means of screening shields 19, 22, 23, 27, 28, 29, 30 at least from above and possibly also laterally. However, in case radiant heat can also have an effect on the ingots 4, 6, 8 from below, the open furnace chamber space is narrowed down on all sides within the range of the ingot ends by means of screening shields 20, 21, 23, 26, 24, 25, 30, 31, 32, 33 arranged above, laterally of and underneath the ingot ends. The screening shields 19-33 are adjustable in height as well as laterally, corresponding to the direction of the arrows in the drawing, in order to be able to adapt the screening shields to the individual lengths and cross sections of the ingots. For effecting this adjustment, hydraulic cylinders 34 can be employed.

The screening shields 19-26 in FIGS. 1 and 2 extend in most cases along the entire furnace length. These screening shields which are made of double-angle-sections within the range of the furnace side walls and of U-type channels in the middle of the furnace, when several rows of ingots are employed, are not cooled. They readily avoid occurrence of peak temperatures at the ingot ends.

The screening shields in FIG. 3 are made of water-cooled cooling ribs which are arranged at the discharge end of the furnace, only. The direction of flow of the coolant into and from the shields is shown by the arrows in FIG. 3. These cooling devices decrease the peak temperatures at the ingot ends to the average ingot temperature, and, thus, the ingots leave the furnace with a uniform temperature over their entire length.

What is claimed is:

1. Continuous heating furnace having a plurality of walls defining an enclosure formed with a heating chamber for elongated metal ingots, such as slab ingots, through which the ingots are transportable transversely in at least one row along at least one conveying route, each of the ingots having two ends and being heatable predominantly by heat radiated from the walls of the furnace, comprising a plurality of screening shields arranged adjacent the conveying route at the ends of the ingots, said screening shields being mounted in said furnace and arranged in front of at least one of said walls for shielding the ends of the ingots against the heat radiated from the walls of the furnace, said shields including horizontal and vertical portions confronting said ends of the ingots and defining at least one niche accommodating one end of the ingot and reducing the size of the heating chamber of the furnace adjacent the end of the ingot, said shields facing the upper and side surfaces of said end of the ingot at said niche, and means adjustably positioning the shields relative to the furnace wall to adjust the spacing with the ingot and thereby define the size of the niches.

2. Continuous heating furnace according to claim 1 wherein said screening shields are disposed above, below and to the sides of the ingots.

3. Continuous heating furnace according to claim 1 wherein said screening shields extend substantially along the entire length of the furnace.

4. Continuous heating furnace according to claim 1 comprising cooling means for said shields.

5. Continuous heating furnace according to claim 4 wherein said cooling means is disposed in the region of the discharge end of the furnace.

6. Continuous heating furnace according to claim 1 wherein at least one of said screening shields faces the lower surface of the end of the ingot.

* * * * *